US011480177B2

(12) United States Patent
Liang et al.

(10) Patent No.: US 11,480,177 B2
(45) Date of Patent: Oct. 25, 2022

(54) AIR INJECTION ENTHALPY-INCREASING SCROLL COMPRESSOR AND REFRIGERATION SYSTEM

(71) Applicant: GUANGDONG MIDEA ENVIRONMENTAL TECHNOLOGIES CO., LTD., Guangdong (CN)

(72) Inventors: Weiheng Liang, Guangdong (CN); Baiying Huang, Guangdong (CN); Osamu Aiba, Guangdong (CN); Kang Zhang, Guangdong (CN); Honghui Chen, Guangdong (CN)

(73) Assignee: GUANGDONG MIDEA ENVIRONMENTAL TECHNOLOGIES CO., LTD., Guangdong (CN)

( * ) Notice: Subject to any disclaimer, the term of this patent is extended or adjusted under 35 U.S.C. 154(b) by 332 days.

(21) Appl. No.: 16/463,960

(22) PCT Filed: Mar. 14, 2017

(86) PCT No.: PCT/CN2017/076595
§ 371 (c)(1),
(2) Date: May 24, 2019

(87) PCT Pub. No.: WO2018/094914
PCT Pub. Date: May 31, 2018

(65) Prior Publication Data

US 2020/0049147 A1 Feb. 13, 2020

(30) Foreign Application Priority Data

Nov. 24, 2016 (CN) ..... 201611060608.9
Nov. 24, 2016 (CN) ..... 201621281105.X

(51) Int. Cl.
*F04C 18/02* (2006.01)
*F04C 23/00* (2006.01)
(Continued)

(52) U.S. Cl.
CPC ..... *F04C 18/0292* (2013.01); *F04C 18/0215* (2013.01); *F04C 18/0253* (2013.01);
(Continued)

(58) Field of Classification Search
CPC ..... F04C 18/0292; F04C 18/0215; F04C 18/0253; F04C 23/008; F04C 27/005; F04C 29/028; F04C 2240/30
See application file for complete search history.

(56) References Cited

U.S. PATENT DOCUMENTS 4,596,520 A * 6/1986 Arata ..... F04C 27/005 418/55.5
4,596,521 A * 6/1986 Murayama ..... F01C 1/0215 418/55.1
(Continued)

FOREIGN PATENT DOCUMENTS

CN 102678547 A 9/2012
CN 103244411 A 8/2013
(Continued)

OTHER PUBLICATIONS

English Machine Translation of JPH0230284(A) translated on Oct. 17, 2021 (Year: 1990).*
(Continued)

*Primary Examiner* — Dominick L Plakkoottam
*Assistant Examiner* — Paul W Thiede
(74) *Attorney, Agent, or Firm* — Scully Scott Murphy & Presser

(57) ABSTRACT

An air injection enthalpy-increasing scroll compressor is provided. The compressor has a main frame, a movable
(Continued)

scroll plate and a stationary scroll plate. The movable scroll plate has a movable plate end plate and a movable scroll wrap arranged on a side end face of the movable plate end plate. A back pressure chamber is defined between the movable plate end plate and the main frame. The stationary scroll plate has a fixed scroll end plate and a stationary scroll wrap arranged on a side end face of the fixed scroll end plate. The stationary scroll wrap and the movable scroll wrap are engaged with each other to form a crescent-shaped compression cavity. The movable scroll plate and the stationary scroll plate are provided with medium pressure passages that, during the rotation of the movable scroll plate, communicate the compression cavity with the back pressure chamber.

11 Claims, 6 Drawing Sheets

(51) Int. Cl.
*F04C 27/00* (2006.01)
*F04C 29/02* (2006.01)

(52) U.S. Cl.
CPC ..... *F04C 23/008* (2013.01); *F04C 27/005* (2013.01); *F04C 29/028* (2013.01); *F04C 2240/30* (2013.01)

(56) References Cited

U.S. PATENT DOCUMENTS 4,669,962 A * 6/1987 Mizuno ..... F04C 27/005 418/55.5
4,958,993 A * 9/1990 Fujio ..... F04C 18/0215 418/55.6
5,169,294 A * 12/1992 Barito ..... F04C 28/26 417/310
5,520,526 A * 5/1996 Fujio ..... F04C 29/126 418/55.4
6,106,253 A 8/2000 Sakai et al.
6,123,528 A * 9/2000 Sun ..... F04C 29/128 137/527
6,202,438 B1 3/2001 Barito
6,264,452 B1 * 7/2001 Sun ..... F04C 29/126 137/527.4
7,695,257 B2 * 4/2010 Joo ..... F04C 28/28 417/310
2006/0093504 A1 * 5/2006 Kim ..... F04C 28/16 418/55.1
2007/0092390 A1 * 4/2007 Ignatiev ..... F04C 23/008 418/55.5
2007/0110605 A1 * 5/2007 Masuda ..... F04C 23/008 418/55.5
2010/0089093 A1 * 4/2010 Kim ..... F04C 18/0253 62/498
2010/0212352 A1 8/2010 Kim et al.
2012/0230854 A1 * 9/2012 Chikano ..... F04C 18/0253 418/55.2
2012/0258004 A1 10/2012 Ignatiev et al.
2013/0216416 A1 * 8/2013 Takeda ..... F04C 18/0253 418/55.1
2016/0298627 A1 * 10/2016 Knippen ..... F25B 49/022

FOREIGN PATENT DOCUMENTS

CN 204476755 U 7/2015
CN 105822546 A 8/2016
CN 106122010 A 11/2016
CN 106368946 A 2/2017
CN 206338185 U 7/2017
JP H02-130284 A 5/1990
JP H9-177683 A 7/1997
JP 2003-97457 A 4/2003
JP 2006-342755 A 12/2006
JP 2009-097418 A 5/2009
JP 2010-164303 A 7/2010
JP 2012-188978 A 10/2012
JP 2013-256878 A 12/2013
JP 2016-164412 A 9/2016

OTHER PUBLICATIONS

English Abstract of CN203717348U (Year: 2014).*
Notice of Reasons for Refusal dated Aug. 18, 2020 received in Japanese Patent Application No. JP 2019-528671 together with an English language translation.
Notice of Reasons for Refusal dated Apr. 28, 2020 received in Japanese Patent Application No. JP 2019-528671 together with an English language translation.
Notification of Reasons for Refusal dated Aug. 14, 2020 received in Korean Patent Application No. KR 10-2019-7016742 together with an English language translation.
First Office Action dated Dec. 28, 2017 received in Chinese Patent Application No. CN 201611060608.9 together with an English language translation.
Extended European Search Report dated Nov. 18, 2019 received in European Patent Application No. EP 17873806.8.
International Search Report dated Aug. 2, 2017 issued in PCT/CN2017/076595.

* cited by examiner

AIR INJECTION ENTHALPY-INCREASING SCROLL COMPRESSOR AND REFRIGERATION SYSTEM

CROSS-REFERENCE TO RELATED APPLICATIONS

This is a national stage of International Application No. PCT/CN2017/076595, filed Mar. 14, 2017, claiming priority based on Chinese Patent Application No. 201621281105.X, filed Nov. 24, 2016 and Chinese Patent Application No. 201611060608.9, filed Nov. 24, 2016, the entire contents of each of which are incorporated herein by reference. No new matter is added.

FIELD

The present disclosure relates to a field of compressors, and more particularly, to an air injection enthalpy-increasing scroll compressor and a refrigeration system.

BACKGROUND

Scroll compressors are widely applied to systems such as air conditioners and heat pumps due to their high efficiency, small size, light weight and steady operation. In the scroll compressors, profiles of the orbiting scroll and the fixed scroll mesh to form a series of crescent-shaped compression cavities. With eccentric operations of the orbiting scroll, the crescent-shaped compression cavity continuously moves from a periphery to a center. Meanwhile, a pressure of a refrigerant keeps rising until the cavity is connected with a central vent hole. The refrigerant becomes a high-pressure gas and is discharged from the compression cavity. The compression process is thus completed.

In the related art, to ensure that the scroll compressor has a satisfying performance under high-pressure-ratio operating conditions (i.e., heating at low temperatures or refrigeration at high temperatures), the enhanced vapor injection scroll compressor is thus invented. That is, a portion of the refrigerant is introduced into the compression cavity before entering an evaporator or a condenser to form a quasi two-stage compression and raise a compression ratio, thereby enhancing the performance of the compressor under high-pressure-ratio operating conditions. During the compression, the orbiting scroll is subjected to a downward axial separation force, thus the orbiting scroll tends to overturn, which causes a leakage between the orbiting scroll and the fixed scroll, leading to a lowered volumetric efficiency. Normally, to prevent the orbiting scroll from overturning, the orbiting scroll end plate is provided with a guiding passage, which guides the pressure of the compression cavity to a back pressure space formed by the orbiting scroll end plate and the main frame, thereby preventing the orbiting scroll from overturning.

However, when the enhanced vapor injection function is turned on, the pressure in the compression cavity rises rapidly; as the guiding passage of the orbiting scroll and the compression cavity during an air injection are not in a normal connection state, the pressure of the back pressure space will not increase correspondingly. Consequently, a back pressure is insufficient, leading to overturning of the orbiting scroll during the air injection and a reduced efficiency of the compressor.

SUMMARY

The present disclosure aims at solving at least one of the technical problems in the prior art. To this end, an objective of the present disclosure is to provide an enhanced vapor injection scroll compressor. During the operation, such an enhanced vapor injection scroll compressor may prevent the orbiting scroll from overturning, thereby improving a performance of the enhanced vapor injection scroll compressor.

Another objective of the present disclosure is to provide a refrigeration system having the above-identified enhanced vapor injection scroll compressor.

An enhanced vapor injection scroll compressor according to a first aspect of the present disclosure includes a compressor housing; a main frame disposed in the compressor housing; an orbiting scroll arranged on the main frame and comprising an orbiting scroll end plate and an orbiting scroll wrap arranged on a side end face, away from the main frame, of the orbiting scroll end plate, a back pressure chamber being defined between the orbiting scroll end plate and the main frame; a fixed scroll arranged at a side, away from the main frame, of the orbiting scroll and comprising a fixed scroll end plate and a fixed scroll wrap arranged on a side end face, adjacent to the main frame, of the fixed scroll end plate, in which the fixed scroll wrap and the orbiting scroll wrap mesh to form a crescent-shaped compression cavity; at least one of the orbiting scroll and the fixed scroll is provided with a medium pressure passage, and the medium pressure passage is configured to connect the compression cavity with the back pressure chamber during a rotation of the orbiting scroll.

According to the enhanced vapor injection scroll compressor in the present disclosure, by providing the medium pressure passage, the medium pressure passage may connect the compression cavity with the back pressure chamber. During the operation of the enhanced vapor injection scroll compressor, a medium pressure of the compression cavity may be guided to the back pressure chamber through the medium pressure passage, thereby preventing the separation of the orbiting scroll and the fixed scroll and ensuring an axial sealing performance between the orbiting scroll and the fixed scroll. In addition, the pressure in the back pressure chamber increases more rapidly through a pressure guidance of the medium pressure passage, thereby shortening the time for the enhanced vapor injection scroll compressor to reach a steady state after being activated.

According to an embodiment of the present disclosure, the medium pressure passage includes at least one of a first medium pressure passage and a second medium pressure passage. The first medium pressure passage is defined in the orbiting scroll, the second medium pressure passage is defined in the fixed scroll, and during the rotation of the orbiting scroll, at least one of the first medium pressure passage and the second medium pressure passage is suitable for connecting the compression cavity with the back pressure chamber.

According to an embodiment of the present disclosure, the first medium pressure passage includes: a first passage extending inwardly from an outer circumferential wall of the orbiting scroll end plate; and a first medium pressure hole, an end of the first medium pressure hole being connected with the first passage, and the other end of the first medium pressure hole penetrating a side end face, adjacent to the fixed scroll, of the orbiting scroll end plate and being connected with the compression cavity.

According to an embodiment of the present disclosure, a cover plate is fixedly connected to the fixed scroll end plate and a closed space is defined between the cover plate and the fixed scroll end plate. The second medium pressure passage includes: a second passage penetrating the fixed scroll end plate in an axial direction and connected with the compression cavity; and a third passage penetrating the fixed scroll end plate and the fixed scroll wrap in the axial direction, connected with the back pressure chamber, and connected with the second passage through the closed space.

According to an embodiment of the present disclosure, the first medium pressure hole is provided at a position adjacent to an inside profile of the orbiting scroll wrap. An enthalpy-increasing hole is formed in the fixed scroll end plate, and when the fixed scroll wrap and the orbiting scroll wrap mesh, the first medium pressure hole and the enthalpy-increasing hole have a phase difference.

According to an embodiment of the present disclosure, a port of the second passage is located at a position adjacent to an inside profile of the fixed scroll wrap and is located at the other side of the enthalpy-increasing hole relative to the first medium pressure hole.

According to an embodiment of the present disclosure, the third passage is positioned outside of the second passage.

According to an embodiment of the present disclosure, the closed space is provided with a backflow preventing device. The backflow preventing device blocks or releases the second passage based on a pressure difference between the compression cavity and the back pressure chamber.

According to an embodiment of the present disclosure, the backflow preventing device includes an elastic valve plate. An end of the elastic valve plate is fixed to the fixed scroll end plate and the other end of the elastic valve plate blocks or releases the second passage under the pressure difference between the compression cavity and the back pressure chamber.

According to an embodiment of the present disclosure, the backflow preventing device further includes a limit baffle. An end of the limit baffle is fixed to the fixed scroll end plate and the limit baffle is positioned between the elastic valve plate and the fixed scroll end plate.

According to an embodiment of the present disclosure, a seal is disposed at a position where the cover plate contacts an end face of the fixed scroll end plate.

According to an embodiment of the present disclosure, a port of the first passage formed at the outer circumferential wall of the orbiting scroll end plate is sealed by the seal, and the orbiting scroll end plate is provided with a second medium pressure hole connected with the first passage and having a free end penetrating the side end face, adjacent to the fixed scroll, of the orbiting scroll end plate; an end face of a free end of the fixed scroll wrap is provided with an annular gas guide groove intermittently connected with the second medium pressure hole along with the rotation of the orbiting scroll, and the annular gas guide groove is connected with the back pressure chamber.

A refrigeration system according to a second aspect of the present disclosure includes a compressor, a condenser, an evaporator and a refrigerant circuit connecting the compressor, the condenser and the evaporator. The compressor is the enhanced vapor injection scroll compressor according to the first aspect of the present disclosure.

Additional aspects and advantages of the present disclosure will be given in the following description, some of which will become apparent from the following description or be learned from practices of the present disclosure.

BRIEF DESCRIPTION OF THE DRAWINGS

The above and/or additional aspects and advantages of the present disclosure will become apparent and easy to understand from descriptions of the embodiments with reference to the drawings.

Figure 1:
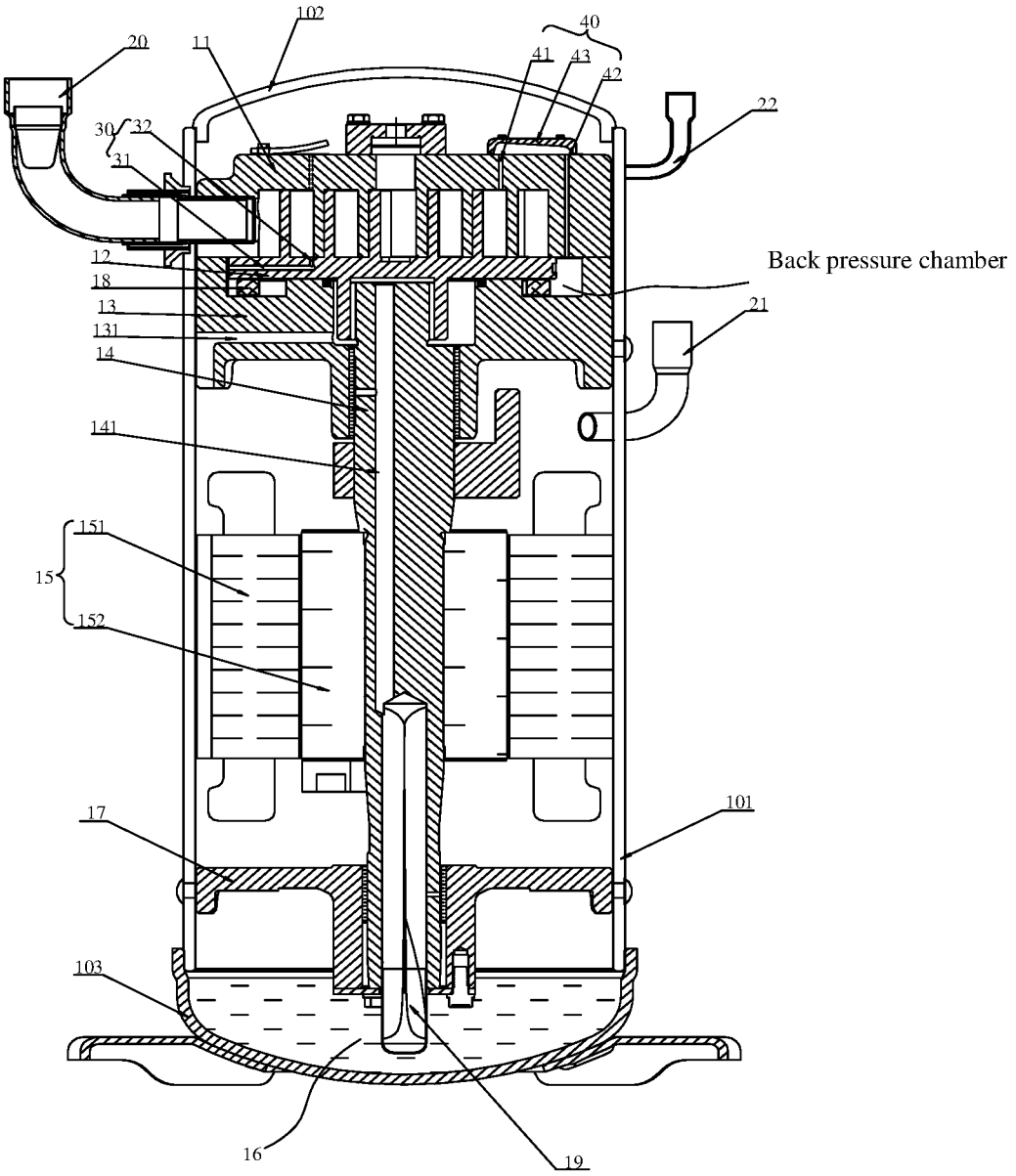
FIG. 1 is a cross-sectional view of a first embodiment of an enhanced vapor injection scroll compressor according to embodiments of the present disclosure.

Reference numerals:

| Reference numerals | Name |
|---|---|
| 101 | housing |
| 102 | upper cover |
| 103 | lower cover |
| 11 | fixed scroll |
| 111 | fixed scroll end plate |
| 112 | fixed scroll wrap |
| 1121 | inside profile of fixed scroll wrap |
| 12 | orbiting scroll |
| 121 | orbiting scroll end plate |
| 122 | orbiting scroll wrap |
| 1221 | outside profile of orbiting scroll wrap |
| 113 | gas guide groove |
| 13 | main frame |
| 131 | oil return hole |
| 14 | crankshaft |
| 141 | center hole |
| 15 | motor |
| 151 | stator |
| 152 | rotor |
| 16 | oil pool |
| 17 | sub-frame |
| 18 | Oldham ring |
| 19 | oil guide member |
| 20 | suction pipe |
| 21 | exhaust pipe |
| 22 | enhanced vapor injection connection pipe |
| 30 | first medium pressure passage |
| 31 | first passage |
| 32 | first medium pressure hole |
| 33 | second medium pressure hole |
| 34 | seal |
| 40 | second medium pressure passage |
| 41 | second passage |
| 411 | port of second |

-continued

| Reference numerals: | |
|---|---|
| Reference numerals | Name |
| | passage |
| 42 | third passage |
| 43 | Cover plate |
| 50 | backflow preventing device |
| 51 | elastic valve plate |
| 52 | limit baffle |
| 60 | enthalpy-increasing hole |

DETAILED DESCRIPTION

Embodiments of the present disclosure will be described in detail and examples of embodiments are illustrated in the drawings. The same or similar elements and the elements having the same or similar functions are denoted by like reference numerals throughout the descriptions. Embodiments described herein with reference to drawings are explanatory, serve to explain the present disclosure, and are not construed to limit embodiments of the present disclosure.

In the description of the present disclosure, it is to be understood that, terms such as "center", "longitudinal", "lateral", "length", "width", "thickness", "over", "below", "front", "back", "left", "right", "vertical", "horizontal", "top", "bottom", "in", "out", "clockwise", "anti-clockwise", "axial", "radial" and "circumferential" refer to the directions and location relations which are the directions and location relations illustrated in the drawings, and for describing the present disclosure and for describing in simple, and which are not intended to indicate or imply that the device or the elements are disposed to locate at the specific directions or are structured and performed in the specific directions, which could not to be understood to the limitation of the present disclosure.

In addition, terms such as "first" and "second" are used herein for purposes of description and are not intended to indicate or imply relative importance or significance. Furthermore, the feature defined with "first" and "second" may comprise one or more this feature distinctly or implicitly. In the description of the present disclosure, "a plurality of" means two or more than two, unless specified otherwise.

In the description of the present disclosure, it should be specified that unless specified or limited otherwise, the terms "mounted" "connected" and "coupled" are understood broadly, such as fixed, detachable mountings, connections and couplings or integrated, and can be mechanical or electrical mountings, connections and couplings or mutual communications, and also can be direct and via media indirect mountings, connections, and couplings, and further can be inner mountings, connections and couplings of two components or interaction relations between two components, which can be understood by those skilled in the art according to the detail embodiment of the present disclosure.

The present disclosure mainly proposes an enhanced vapor injection scroll compressor. Through arranging a medium pressure passage connecting a compression cavity and a back pressure chamber, during the operation of the enhanced vapor injection scroll compressor, a medium pressures of the compression cavity may be guided to the back pressure chamber through the medium pressure passage, thereby preventing the separation of an orbiting scroll and a fixed scroll and ensuring an axial sealing performance between an orbiting scroll and a fixed scroll. In addition, a pressure in the back pressure chamber increases more rapidly through the pressure guidance of the medium pressure passages, thereby shortening the time for the enhanced vapor injection scroll compressor to reach a steady state after being activated.

The enhanced vapor injection scroll compressor may be applied to a refrigeration system such as an air conditioner, a refrigerator, a cold storage and so on. The enhanced vapor injection scroll compressor sucks low-temperature, low-pressure refrigerant gas from a suction pipe, compresses the gas through the operation of the motor and then discharges high-temperature, high-pressure refrigerant gas to an exhaust pipe, thereby providing power for the refrigeration cycle. Meanwhile, the enhanced vapor injection scroll compressor also has an enhanced vapor injection function. Specifically, an air injection passage is formed in the fixed scroll, and a portion of the refrigerant that has gone through a heat exchange is introduced into the compression cavity to form a quasi two-stage compression, thereby raising the compression ratio and enhancing the performance of the enhanced vapor injection scroll compressor under high-pressure-ratio operating conditions.

Figure 2:
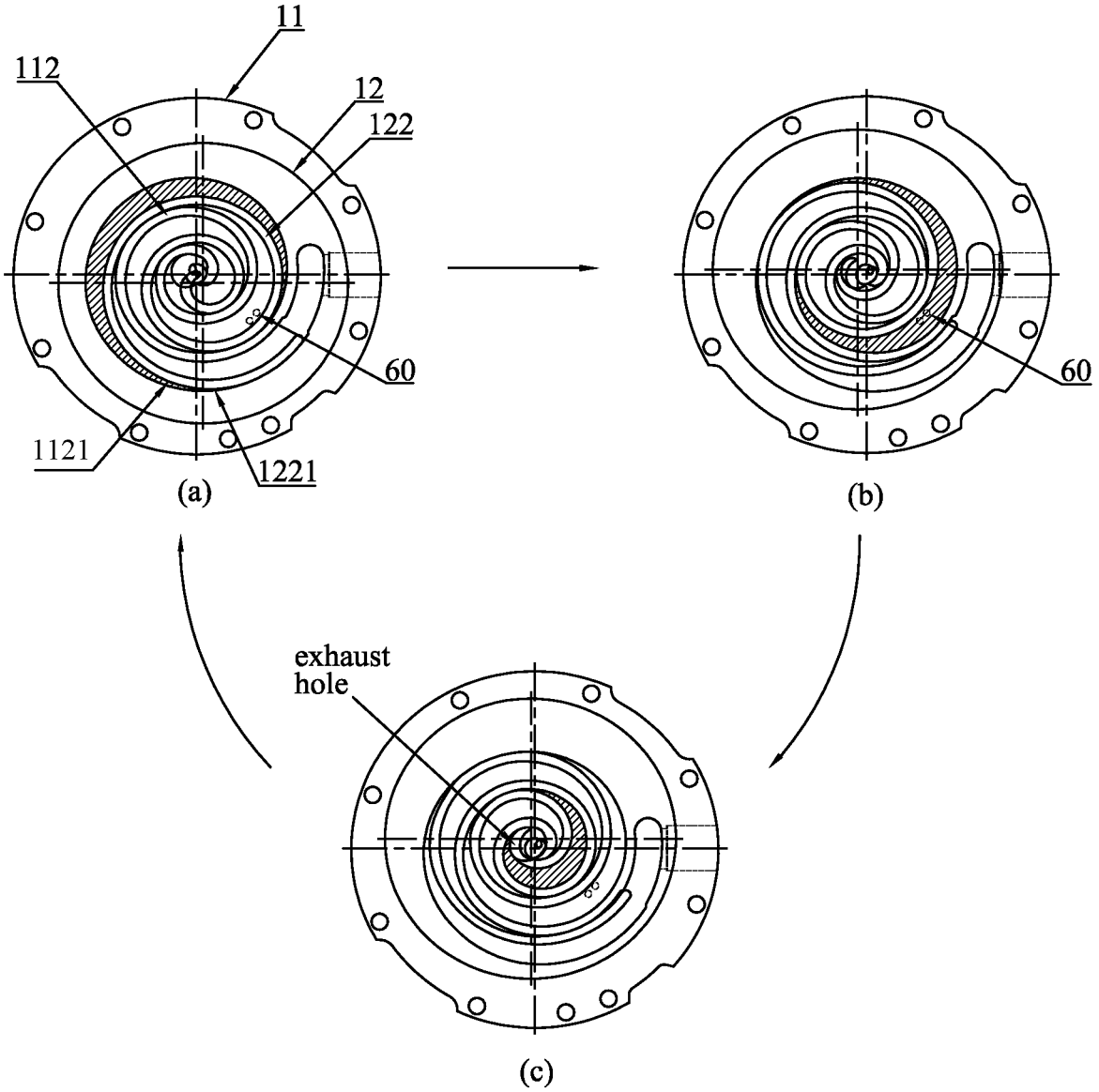
FIG. 2 is a schematic diagram illustrating a compression process of a meshing orbiting scroll and fixed scroll in an enhanced vapor injection scroll compressor.

As illustrated in FIG. 1 and FIG. 2, the enhanced vapor injection scroll compressor includes a closed accommodating space, i.e., the compressor housing, defined by a housing 101, an upper cover 102 and a lower cover 103. The accommodating space is provided with a fixed scroll 11, an orbiting scroll 12, a main frame 13, a crankshaft 14, a motor 15, an oil pool 16, a sub-frame 17 and an Oldham ring 18.

Specifically, the housing 101 may be formed as a cylindrical body whose both ends are open. The upper cover 102 is fixedly coupled to an open end of the cylindrical body, and a middle portion of the upper cover 102 is arched in a direction away from the cylindrical body. The lower cover 103 is fixedly coupled to the other open end of the cylindrical body, and a middle portion of the lower cover 103 is arched in a direction away from the cylindrical body. The arched lower cover 103 and the above-mentioned cylindrical body enclose the oil pool 16 at a bottom of the enhanced vapor injection scroll compressor. The oil pool 16 is configured to contain lubricating oil. A suction pipe 20, an exhaust pipe 21 and an enhanced vapor injection connection pipe 22 are coupled to side walls of the cylindrical body.

The main frame 13 is disposed in the cylindrical body. The main frame 13 has a columnar shape as a whole and a gap is formed between an outer peripheral wall of the main frame 13 and an inner peripheral wall of the cylindrical body. The fixed scroll 11 may be fixedly disposed on the main frame 13. The fixed scroll 11 includes a fixed scroll end plate 111 and a fixed scroll wrap 112. The orbiting scroll 12 is located below the fixed scroll 11 and is supported by the main frame 13. The orbiting scroll 12 includes an orbiting scroll end plate 121, an orbiting scroll wrap 122 and a hub. The fixed scroll wrap 112 and the orbiting scroll wrap 122 mesh to form a series of crescent-shaped compression cavities. In addition, the main frame 13 is further provided with an oil storage portion, and an oil return hole 131 is provided at the bottom of the oil storage portion. A center of the main frame 13 is also provided with a through hole for the crankshaft 14.

The motor 15 is disposed in the cylindrical body and located below the main frame 13. The motor 15 may include a stator 151 and a rotor 152. The sub-frame 17 is located below the motor 15. A space between the motor 15 and the main frame 13 and a space between the motor 15 and the sub-frame 17 define a high-pressure cavity together. An end of the exhaust pipe 21 passes through the housing 101 and extends into the high-pressure cavity.

An end of the crankshaft 14 passes through the rotor 152 and the main frame 13 in sequence, and is coupled to the hub of the orbiting scroll 12. The other end of the crankshaft 14 passes through the sub-frame 17 and is coupled to an oil guide member 19, the oil guiding member 19 extends to the oil pool 16. A central oil hole 141 is provided in the crankshaft 14.

During the operation of the enhanced vapor injection scroll compressor, the refrigerant is sucked into the compression cavity through the suction pipe 20 for a compression. After the compression is completed, the refrigerant is discharged to the exhaust cavity through the exhaust hole provided in the fixed scroll end plate 111, then discharged downward to the high-pressure cavity where the motor 15 is located and finally discharged by the exhaust pipe 21. When the enhanced vapor injection scroll compressor operates, under the action of the oil guide member 19 at the lower portion of the crankshaft 14, the lubricating oil is supplied to the upper portion of the cylindrical body from the oil pool 16 along the central oil hole 141 of the crankshaft 14, enters the oil storage portion of the main frame 13 after lubricating the a bearing of the compressor and returns to the bottom oil pool 16 after flowing out through the oil return hole 131.

As illustrated in FIG. 2, the orbiting scroll 12 rotates about a center of the fixed scroll at a certain eccentric distance, and the fixed scroll wrap 112 and the orbiting scroll wrap 122 mesh to form a series of crescent-shaped spaces. The enhanced vapor injection scroll compressor is activated and rotates clockwise. When the enhanced vapor injection scroll compressor rotates to a position illustrated in FIG. 2*a*, an inside profile 1121 of the fixed scroll wrap 112 and an outside profile 1221 of the orbiting scroll wrap 122 define a closed space (a hatched portion as illustrated in section (a) of FIG. 2) together, i.e., a suction space, the suction process is thus completed. As the enhanced vapor injection scroll compressor rotates clockwise, when the enhanced vapor injection scroll compressor rotates to a position illustrated in section (b) of FIG. 2, the position of the crescent-shaped space changes, and an area of the hatched portion is continuously reduced, in which case a compression space is formed, and the refrigerant is compressed in the compression space and the pressure is increased. When the enhanced vapor injection scroll compressor rotates to a position illustrated in section (c) of FIG. 2, a volume of the compression space continuously decreases and the compression space starts to connect with the exhaust hole in the fixed scroll end plate 111. At this time, the pressure of the refrigerant reaches the pressure for gas exhaust basically and the hatched portion becomes an exhaust space and the refrigerant is discharged from the exhaust port. Therefore, a compression cycle is completed.

In the compression process described above, the orbiting scroll 12 is subjected to a downward axial separation force and tends to overturn, resulting a leakage between the orbiting scroll 12 and the fixed scroll 11, and leading to a lowered volumetric efficiency. Consequently, the enhanced vapor injection scroll compressor according to embodiments of the present disclosure adopts a medium pressure passage and guides the medium pressure of the compression cavity to the back pressure chamber to increase the pressure of the back pressure chamber, such that a back of the orbiting scroll 12 is subjected to an upward back pressure, thereby preventing the orbiting scroll 12 from overturning. The back of the orbiting scroll 12 and an upper portion of the main frame 13 enclose the back pressure chamber.

Figure 3:
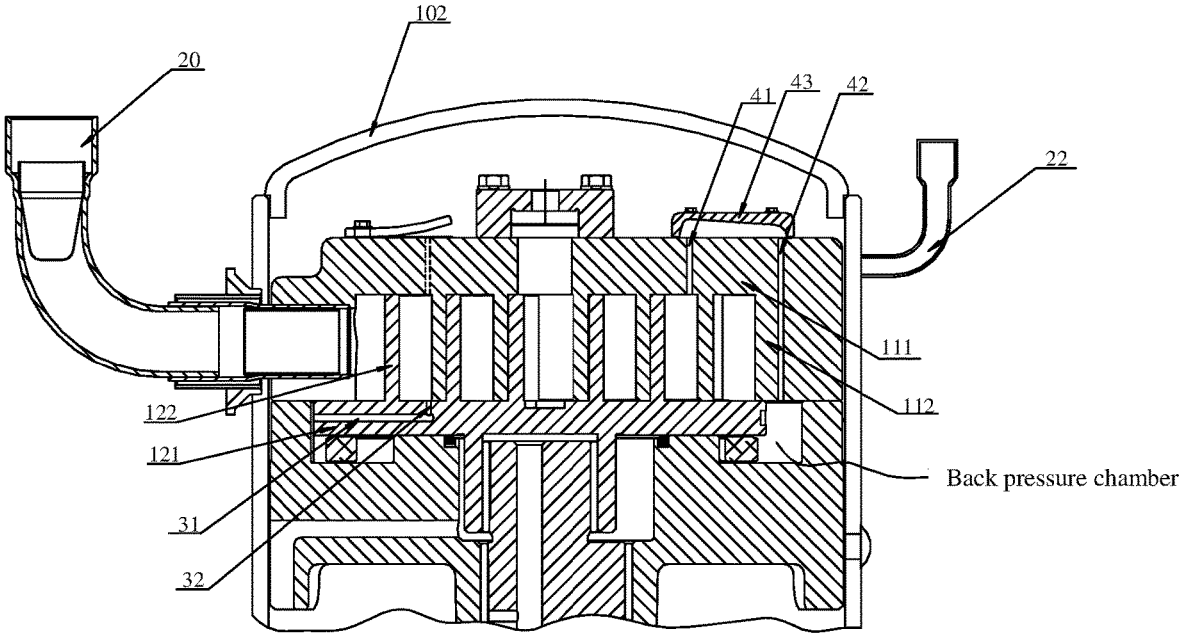
FIG. 3 is a partial cross-sectional view of the enhanced vapor injection scroll compressor illustrated in FIG. 1.

Specifically, as illustrated in FIG. 1 and FIG. 3, the medium pressure passage includes a first medium pressure passage 30 provided in the orbiting scroll 12 and a second medium pressure passage 40 provided in the fixed scroll 11. The first medium pressure passage 30 includes a first passage 31 extending inwardly from an outer circumferential wall of the orbiting scroll end plate 121 and a first medium pressure hole 32 connecting with the first passage 31 and penetrating an end face of the orbiting scroll end plate 121. The compression cavity is connected with the back pressure chamber through the first medium pressure hole 32 and the first passage 31.

The second medium pressure passage 40 includes a second passage 41 disposed to the fixed scroll 11 and penetrating the fixed scroll end plate 111 in the axial direction and a third passage 42 disposed on the fixed scroll 11 and penetrating the fixed scroll end plate 111 and the fixed scroll wrap 112 in the axial direction. In addition, the third passage 42 is located at an outer peripheral side of the fixed scroll 11 and connects with the back pressure chamber of the compressor. The second passage 41 is located at a side, adjacent to the center, of the fixed scroll 11 and connects with the compression cavity. The second passage 41 and the third passage 42 are connected through a closed space defined by the cover plate 43. Specifically, the cover plate 43 may be concave and fixed to the fixed scroll end plate 111 to form the closed space. The compression cavity is connected with the back pressure chamber through the closed space defined by the second passage 41, the third passage 42 and the cover plate 43. To form the closed space, a seal, for example, a seal spacer, may be disposed at the position where the cover plate 43 contacts an end face of the fixed scroll end plate 111 and may be fixed by screws or bolts.

Figure 4:
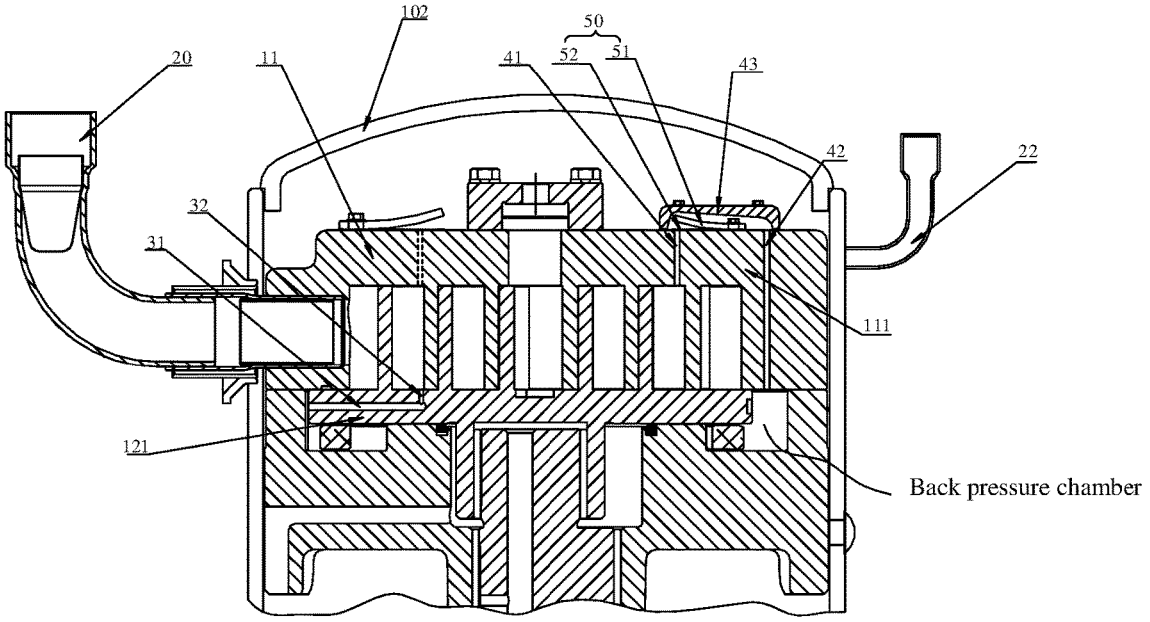
FIG. 4 is a partial cross-sectional view of a second embodiment of an enhanced vapor injection scroll compressor according to embodiments of the present disclosure.

Further, as illustrated in FIG. 4, to prevent gas in the back pressure chamber from flowing back to the compression cavity, a backflow preventing device 50 may be provided in the cover plate 43. The backflow preventing device 50 blocks or releases the second passage 41 based on a pressure difference between the compression cavity and the back pressure chamber. Specifically, when the pressure of the compression cavity is greater than the pressure of the back pressure chamber, the backflow preventing device 50 releases the second passage 41, thus gas in the compression cavity may enter the back pressure chamber along the second passage 41 and the third passage 42. When the pressure of the compression cavity is smaller than that of the back pressure chamber, the backflow preventing device 50 blocks the second passage 41, thus the gas in the back pressure chamber cannot enter the compression cavity along the third passage 42 and the second passage 41.

Specifically, the backflow preventing device 50 may include an elastic valve plate 51 and a limit baffle 52. An end of the elastic valve plate 51 is fixed to the fixed scroll end plate 111 and the other end of the elastic valve plate 51 may block or release the second passage 41 under the action of pressure. The limit baffle 52 is fixed to the fixed scroll end plate 111 and located between the elastic valve plate 51 and the fixed scroll end plate 111. The limit baffle 52 is mainly configured to limit a deformation path of the elastic valve plate 51, such that it can be ensured that the deformation of the elastic valve plate 51 does not exceed an elasticity limit of itself. It can be understood that it is possible to only use the elastic valve plate 51 if it has better elasticity. In addition, the limit baffle 52 may be disposed above or below the elastic valve plate 51.

It should be noted that the elastic valve plate 51 is preferably made of materials having good elasticity and sealing performance, for example, 7C steel manufactured by Sandvik. The elastic valve plate 51 may be arranged in a strip shape, a fan shape or other shapes, and no specific limitations are made herein.

It can be understood that the second medium pressure passage 40 may be of other structures. Any connection structure that may connect the second passage 41 and the third passage 43 and be separated from the exhaust cavity falls in the protection scope of the present disclosure.

The enhanced vapor injection scroll compressor according to embodiments of the present disclosure, by providing the first medium pressure passage 30 and the second medium pressure passage 40, the compression cavity and the back pressure chamber of the enhanced vapor injection scroll compressor are connected. During the operation of the enhanced vapor injection scroll compressor, the medium pressure of the compression cavity may be guided to the back pressure chamber through the first medium pressure passage 30 and the second medium pressure passage 40, thereby preventing the separation of the orbiting scroll 12 and the fixed scroll 11 and ensuring the axial sealing performance between the orbiting scroll 12 and the fixed scroll 11. In addition, the pressure in the back pressure chamber increases more rapidly through the pressure guidance of the first medium pressure passage 30 and the second medium pressure passage 40, thereby shortening the time for the enhanced vapor injection scroll compressor to reach a steady state after being activated.

Figure 5:
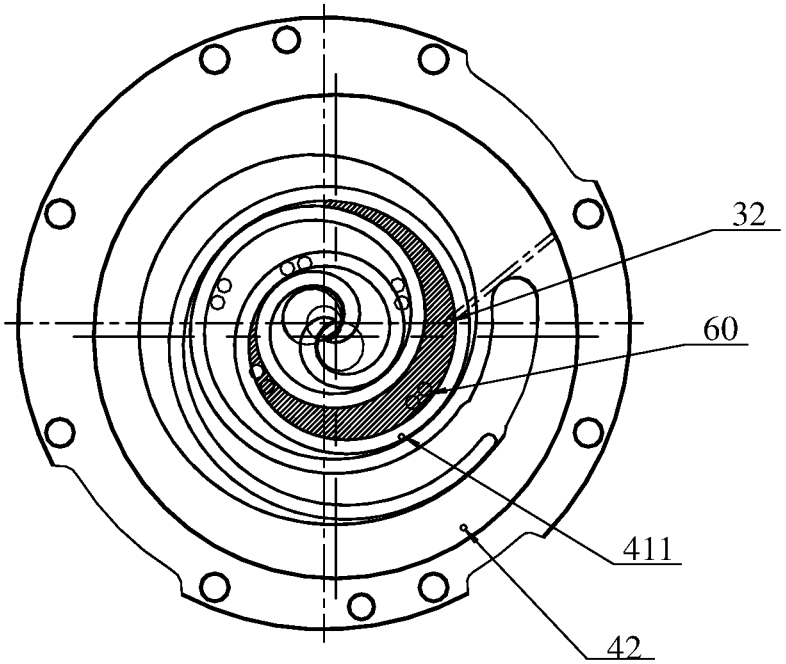
FIG. 5 is a plan view of a meshing orbiting scroll and fixed scroll in an enhanced vapor injection scroll compressor according to embodiments of the present disclosure in a position.
Figure 6:
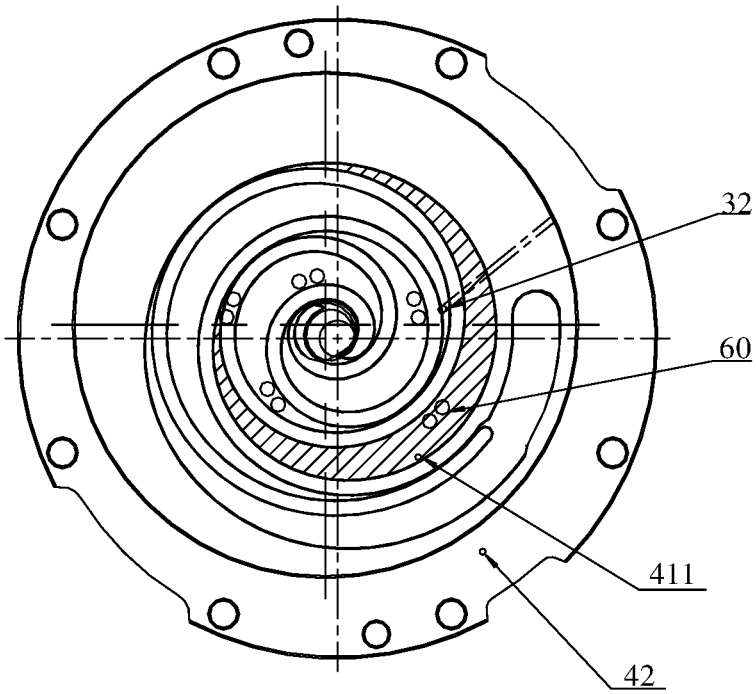
FIG. 6 is a plan view of a meshing orbiting scroll and fixed scroll in an enhanced vapor injection scroll compressor according to embodiments of the present disclosure in another position.

As illustrated in FIG. 3, FIG. 5 and FIG. 6, the first medium pressure hole 32 is provided at a position adjacent to the inside profile of the orbiting scroll wrap. And when the orbiting scroll 12 and the fixed scroll 11 mesh, a phase difference is formed between the first medium pressure hole and the enthalpy-increasing hole 60 provided in the fixed scroll end plate. The enthalpy-increasing hole 60 is formed inwardly in the axial direction from an end face of the fixed scroll end plate 111 where the fixed scroll wrap 112 is disposed. An enthalpy-increasing passage is formed inwardly from the outer peripheral wall of the fixed scroll end plate and is connected with the enthalpy-increasing hole 60. The enthalpy-increasing passage extends to the outer peripheral wall of the fixed scroll end plate 111 and is connected with the enhanced vapor injection connection pipe 22. The port 411 of the second passage 41 is located at a position adjacent to the inside profile of the fixed scroll wrap and is at a position on the other side of the enthalpy-increasing hole 60 relative to the first medium pressure hole 32. When the orbiting scroll and the fixed scroll are in a position illustrated in FIG. 5, the first medium pressure hole 32 and the enthalpy-increasing hole 60 are in the same compression cavity, and the compression cavity is formed by the inside profile of the orbiting scroll wrap and the outside profile of the fixed scroll wrap meshing, which is called cavity B. When the orbiting scroll and the fixed scroll are in a position illustrated in FIG. 6, the port 411 of the second passage 41 and the enthalpy-increasing hole 60 are in the same compression cavity, and the compression cavity is formed by the outside profile of the orbiting scroll wrap and the inside profile of the fixed scroll wrap meshing, which is called cavity A. Therefore, when the enhanced vapor injection function is turned on, the pressure in the compression cavity increases. If the enthalpy-increasing hole is in cavity B, then the pressure in cavity B may be guided to the back pressure chamber through the first medium pressure hole 32. Consequently, the back pressure of the orbiting scroll end plate 121 increases correspondingly, preventing the orbiting scroll 12 from overturning. If the enthalpy-increasing hole 60 is in cavity A, then the pressure in cavity A is guided to the back pressure chamber through the port 411 of the second passage 41. Therefore, the back pressure of the orbiting scroll end plate 121 increases correspondingly, preventing the orbiting scroll 12 from overturning.

Therefore, in the embodiments of the present disclosure, through the arrangement positions of the first medium pressure passage 30 and the second medium pressure passage 40, the back pressure of the orbiting scroll end plate 121 may increase correspondingly whenever the enhanced vapor injection function is turned on, thereby guaranteeing the axial sealing performance between the orbiting scroll 12 and the fixed scroll 11.

It can be understood that the position of the first medium pressure hole 32 of the first medium pressure passage 30 and the position of the port 411 of the second passage 41 in the second medium pressure passage 40 are not limited to structures in the above embodiments. Any structure is feasible as long as that during the rotation of the enhanced vapor injection scroll compressor, either of the first medium pressure hole 32 of the first medium pressure passage 30 and the port 421 of the second passage 42 is connected with the compression cavity, thereby connecting the compression cavity with the back pressure chamber and guaranteeing the axial sealing performance between the orbiting scroll and the fixed scroll.

Figure 7:
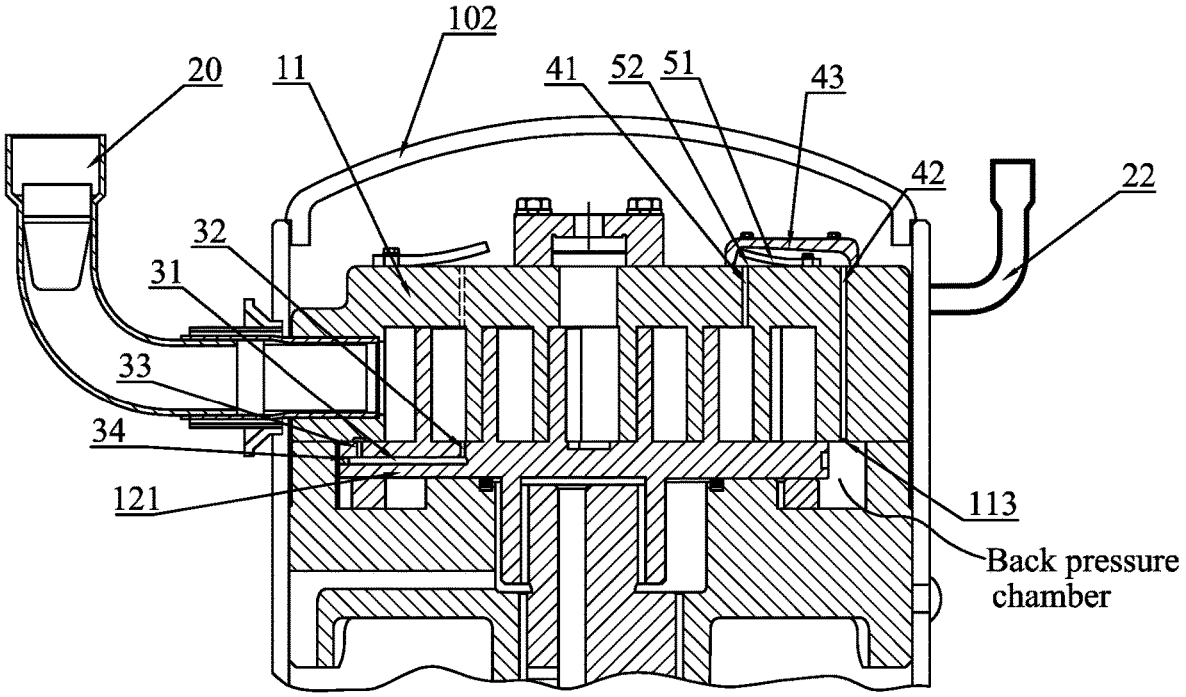
FIG. 7 is a partial cross-sectional view of a third embodiment of an enhanced vapor injection scroll compressor according to embodiments of the present disclosure.
Figure 8:
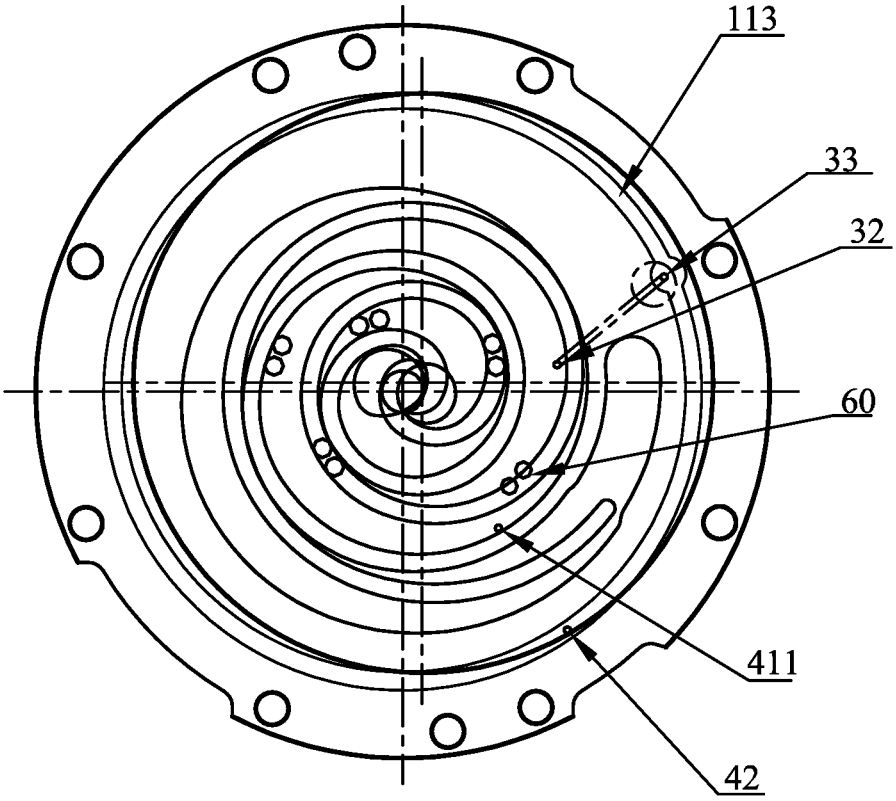
FIG. 8 is a diagram illustrating a meshing structure of an orbiting scroll and a fixed scroll in a third embodiment of an enhanced vapor injection scroll compressor according to embodiments of the present disclosure.

Further, as illustrated in FIGS. 7 and 8, in the first medium pressure passage 30, the port, in the outer peripheral wall of the orbiting scroll end plate 121, of the first passage 31 in the orbiting scroll end plate 121 may be sealed by the seal 34. At the same time, the orbiting scroll end plate 121 may further be provided with a second medium pressure hole 33 connecting with the first passage 31 and penetrating the orbiting scroll end plate 121. In addition, an end face of the fixed scroll wrap 112 is also provided with an annular gas guide groove 113 connected with the second medium pressure hole 33. The open end of the annular gas guide groove 113 connects with the back pressure chamber, and the movement path of the second medium pressure hole 33 moving with the rotation of the orbiting scroll 12 is in the shape of S. Therefore, it is understood that the gas guide groove 113 intermittently connects with the second medium pressure hole 33 during the rotation of the orbiting scroll 12.

With the rotation of the orbiting scroll 12, the pressure in the compression cavity where the first medium pressure hole 31 and the port 411 of the second passage 41 are located keeps changing. Consequently, the back pressure in the back pressure chamber also keeps changing. If the pressure in the back pressure chamber is greater than that in the compression cavity, gas in the back pressure chamber may flow back to the compression cavity and be compressed again, which leads to a pulsation loss and reduces the efficiency of the enhanced vapor injection scroll compressor. Therefore, through the intermittent connection between the first medium pressure passage 30 and the annular gas guide groove 113, the backflow preventing device 50 of the second medium pressure passage 40 may keep a large amount of gas in the back pressure space from flowing back and forth in the compression cavity and the back pressure chamber, thus preventing an efficiency reduction of the enhanced vapor injection scroll compressor. In addition, as the operating condition changes, for example, from a high load operating condition to a low load operating condition, an excessive back pressure may be slowly released through the intermittent communication of the first medium pressure passage 30, which enables the back pressure to reach a stable state gradually.

In addition, upon startup of the enhanced vapor injection scroll compressor, the compression pressure is greater than the pressure in the back pressure chamber, the orbiting scroll 12 is separated from the fixed scroll 11 in a certain degree and the operation of the enhanced vapor injection scroll compressor is unsteady. At this time, gas in the compression cavity may enter the back pressure chamber through the first medium pressure passage 30 and the second medium pressure passage 40. Since the gas may enter the back pressure chamber through the two passages (i.e., the first medium pressure passage 30 and the second medium pressure passage 40) simultaneously, back pressure may be established quickly to reach the designed back pressure value, so that the enhanced vapor injection scroll compressor may reach a steady state quickly and time for the startup is thus reduced.

The refrigeration system according to embodiments of the present disclosure includes a compressor, a condenser, an evaporator and a refrigerant circuit connecting the compressor, the condenser and the evaporator. The compressor is the enhanced vapor injection scroll compressor according to the above-mentioned embodiments of the present disclosure.

By arranging the above-identified enhanced vapor injection scroll compressor, the refrigeration system according to embodiments of the present disclosure may improve an overall performance of the refrigeration system.

Other configurations and operations of the refrigeration system according to embodiments of the present disclosure are known to a person skilled in the art and thus will not be described in detail herein.

Reference throughout this specification to "an embodiment", "some embodiments", "an exemplary embodiment", "an example", "a specific example", or "some examples" means that a particular feature, structure, material, or characteristic described in connection with the embodiment or example is included in at least one embodiment or example of the present disclosure. In this specification, exemplary descriptions of aforesaid terms are not necessarily referring to the same embodiment or example. Furthermore, the particular features, structures, materials, or characteristics may be combined in any suitable manner in one or more embodiments or examples.

Although embodiments of present disclosure have been illustrated and described above, it should be understood by those skilled in the art that changes, alternatives, and modifications can be made to the embodiments without departing from spirit and principles of the present disclosure. The scope of the present disclosure is limited by the attached claims and its equivalents.

What is claimed is:

1. An enhanced vapor injection scroll compressor, comprising:

a compressor housing;

a main frame disposed in the compressor housing;

an orbiting scroll arranged on the main frame and comprising an orbiting scroll end plate and an orbiting scroll wrap arranged on a side end face of the orbiting scroll end plate away from the main frame, a back pressure chamber being defined between the orbiting scroll end plate and the main frame;

a fixed scroll arranged on a side of the orbiting scroll away from the main frame and comprising a fixed scroll end plate and a fixed scroll wrap arranged on a side end face of the fixed scroll end plate adjacent to the main frame, and the fixed scroll wrap and the orbiting scroll wrap meshing to form a plurality of crescent-shaped compression cavities;

wherein the orbiting scroll comprises a first medium pressure passage that is configured to connect a first compression cavity of the plurality of compression cavities with the back pressure chamber; and wherein the fixed scroll comprises a second medium pressure passage that is configured to connect a second compression cavity of the plurality of compression cavities with the back pressure chamber;

wherein the fixed scroll comprises an annular gas guide groove extending partially around a circumference of the fixed scroll wrap and disposed at least partially between the fixed scroll wrap and the back pressure chamber;

wherein the first medium pressure passage is configured to connect the first compression cavity with the back pressure chamber via the annular gas guide groove; and wherein the second medium pressure passage is configured to connect the second compression cavity with the back pressure chamber via the annular gas guide groove.

2. The enhanced vapor injection scroll compressor according to claim 1, wherein the first medium pressure passage comprises:

a first passage extending inwardly from an outer circumferential wall of the orbiting scroll end plate; and a first medium pressure hole comprising a first end and a second end, the first end of the first medium pressure hole being connected with the first passage, the second end of the first medium pressure hole penetrating a side end face, adjacent to the fixed scroll, of the orbiting scroll end plate, the second end of the first medium pressure hole being connected with the first compression cavity of the plurality of compression cavities.

3. The enhanced vapor injection scroll compressor according to claim 2, wherein:

a cover plate is fixedly connected to the fixed scroll end plate and a closed space is defined between the cover plate and the fixed scroll end plate; and the second medium pressure passage comprises:

a second passage penetrating the fixed scroll end plate in an axial direction, the second passage being connected with the second compression cavity of the plurality of compression cavities; and a third passage penetrating the fixed scroll end plate and the fixed scroll wrap in the axial direction, the third passage being connected with the back pressure chamber and connected with the second passage through the closed space.

4. The enhanced vapor injection scroll compressor according to claim 3, wherein:

the first medium pressure hole is provided at a position adjacent to an inside profile of the orbiting scroll wrap; and an enthalpy-increasing hole is formed in the fixed scroll end plate, and when the fixed scroll wrap and the orbiting scroll wrap mesh, a phase difference exists between the first medium pressure hole and the enthalpy-increasing hole.

5. The enhanced vapor injection scroll compressor according to claim 4, wherein a port of the second passage is located at a position adjacent to an inside profile of the fixed scroll wrap and is located at another side of the enthalpy-increasing hole relative to the first medium pressure hole.

6. The enhanced vapor injection scroll compressor according to claim 3, wherein the third passage is positioned outside the second passage.

7. The enhanced vapor injection scroll compressor according to claim 3, wherein the closed space is provided with a backflow preventing device, and the backflow preventing device blocks or releases the second passage based on a pressure difference between the compression cavity and the back pressure chamber.

8. The enhanced vapor injection scroll compressor according to claim 7, wherein the backflow preventing device comprises an elastic valve plate, an end of the elastic valve plate is fixed to the fixed scroll end plate, and another end of the elastic valve plate blocks or releases the second passage under the pressure difference between the second compression cavity and the back pressure chamber.

9. The enhanced vapor injection scroll compressor according to claim 8, wherein the backflow preventing device further comprises a limit baffle, an end of the limit baffle is fixed to the fixed scroll end plate, and the limit baffle is positioned between the elastic valve plate and the fixed scroll end plate.

10. The enhanced vapor injection scroll compressor according to claim 2, wherein:

a port of the first passage formed at the outer circumferential wall of the orbiting scroll end plate is sealed by the seal, and the orbiting scroll end plate is provided with a second medium pressure hole connected with the first passage and having a free end penetrating the side end face, adjacent to the fixed scroll of the orbiting scroll end plate; and the annular gas guide groove is intermittently connected with the second medium pressure hole along with the rotation of the orbiting scroll.

11. A refrigeration system comprising a compressor, a condenser, an evaporator and a refrigerant circuit connecting the compressor, the condenser and the evaporator, wherein the compressor is an enhanced vapor injection scroll compressor according to claim 1.

* * * * *